United States Patent [19]

Nantz

[11] Patent Number: 4,561,801

[45] Date of Patent: Dec. 31, 1985

[54] METHOD AND APPARATUS FOR INHIBITING EROSION

[76] Inventor: Milton J. Nantz, 3602 Naranja Way, Sarasota, Fla. 33582

[21] Appl. No.: 575,594

[22] Filed: Jan. 31, 1984

[51] Int. Cl.[4] ..... E02B 5/00; E02B 11/00

[52] U.S. Cl. ..... 405/15; 405/36; 405/118

[58] Field of Search ..... 405/15, 36, 118, 119, 405/258

[56] References Cited

U.S. PATENT DOCUMENTS

| | | | |
|---|---|---|---|
| 643,677 | 2/1900 | Payne . | |
| 725,793 | 4/1903 | Suddath . | |
| 856,702 | 6/1907 | Howley . | |
| 938,204 | 10/1909 | Austin . | |
| 993,244 | 5/1911 | Hansbrough . | |
| 1,878,295 | 9/1932 | Richmond | 405/36 |
| 2,050,798 | 8/1936 | Kothe | 72/126 |
| 2,051,228 | 8/1936 | Sondag | 94/33 |
| 2,170,671 | 8/1939 | Adler | 405/118 |
| 2,372,187 | 3/1945 | Davison | 26/2 |
| 2,994,254 | 8/1961 | Shumaker | 94/26 |
| 3,626,823 | 12/1971 | Toth | 94/31.1 |
| 3,636,830 | 1/1972 | Watts | 94/33 |
| 3,735,596 | 5/1973 | Stephenson | 61/14 |
| 4,031,009 | 6/1977 | Hicks | 210/164 |
| 4,070,864 | 1/1978 | Jarvis | 61/29 |
| 4,199,272 | 4/1980 | Lacey | 405/36 |
| 4,307,975 | 12/1981 | Heitman | 405/36 |

*Primary Examiner*—David H. Corbin

*Attorney, Agent, or Firm*—Beveridge, DeGrandi & Weilacher

[57] ABSTRACT

A structure which inhibits erosion of a hillside having a grade includes an upwardly open trough extending down the grade of the hillside, the trough having lateral skirts buried in the hillside to a depth below the lowermost trough depth measured transversely. The skirts and the trough are impervious to water and sealed together in watertight fashion and the trough forms a channel which is transversely lowermost in a valley extending down the grade of the hillside. The valley has sidewalls which slope gently toward the trough and are covered with sod. Runoff is directed by the valley to the trough in noneroding manner and the trough conducts runoff down the hillside.

9 Claims, 3 Drawing Figures

METHOD AND APPARATUS FOR INHIBITING EROSION

BACKGROUND OF THE INVENTION

Soil conservation is a matter of concern worldwide, and especially in the United States. It has been estimated that at one time there was an average of 18 inches of top soil in the United States and that has now been reduced to a mere 8 inches. This loss of topsoil may have profound negative implications for world food supplies if it is allowed to continue.

Most topsoil loss is caused by water erosion; that is, the topsoil is carried off with rainwater and melting snows and eventually reaches rivers. This brings about the additional problems of the silting and polluting of rivers and clogging of otherwise navigable waterways.

Numerous attempts have been made to inhibit erosion, with varying degrees of success.

However, applicant is not aware of any proposals which provide the effective protection of hillsides against erosion with as little cost and labor required as in applicant's invention, as described hereinafter.

Erosion generally occurs when water in excess of the amounts capable of being absorbed falls on land in the form of rain. Additional water may be supplied by melting snow and ice. Under the influence of gravity the water flows toward the lowest point, where it joins with similar flows, eventually building into a rivulet of increasing volume. The moving water in the rivulet entrains soil particles and carries them downstream. The greater the rate of flow, the greater the tendency to entrain and carry soil particles downstream. Accordingly, to the extent that the flow rate can be minimized or, where high flow rates exist, isolated from the soil, the less the soil will be eroded.

In addition, it is often desirable to retain water in the soil, rather than allowing it to flow downstream during a brief, heavy rain, such as a thunderstorm. In a thunderstorm the rate of precipitation may be so great that the water has very little time to penetrate the soil where it can be stored for later use by plants, and instead merely runs along the surface, eroding the surface and passing downstream to rivers, lakes and the sea.

Accordingly, there is a need in the art not only for a method and apparatus for inhibiting erosion, but also for returning fast moving water to the subsoil where it can be absorbed and used as needed by growing plants, or tapped by men and women.

SUMMARY OF THE INVENTION

The present invention fulfills this need by providing a structure for inhibiting erosion of a hillside having a grade. The structure includes an upwardly open trough extending down the grade of the hillside, and the trough has lateral skirts buried in the hillside to a depth below the lowermost trough depth measured transversely. The skirts and the trough are impervious to water and sealed together in watertight fashion. The trough forms a channel which is transversely lowermost in a valley extending down the grade of the hillside, the valley having sidewalls gently sloping toward the trough and being covered with sod. Runoff is directed by the valley to the trough in noneroding manner and the trough conducts runoff down the hillside.

Usually, the hillside has subsoil, and the structure includes a cry well retention basin located in alignment with the trough, spaced from the top thereof, for receiving runoff from the trough and returning the runoff to the subsoil of the hillside. In such cases an additional trough may be provided on the hillside downhill from the dry well retention basin. This additional trough also has lateral skirts buried in the hill to a depth transversely below the lowermost depth of the additional trough. In addition, an upper transverse skirt at an upper end of the additional trough connects the lateral skirts of the additional trough and is buried in the hillside to a depth transversely below the lateral skirts.

Typically, the trough is made of a plurality of trough sections joined together in watertight fashion. The trough may be provided with transverse ribs that reduce runoff speed. If desirable, the trough may have branches. Preferably, the valley sidewalls are no steeper transversely than about 1:6.

The invention includes a method of preventing soil erosion on a hillside having a valley including the steps of excavating two longitudinal incisions on opposed sides of the bottom of tne valley, forming the surface of the bottom between the incisions to receive a trough underside, installing a trough having lateral skirts on the bottom of the valley, inserting the skirts into the incisions to a depth below the transversely lowermost trough depth, backfilling the incisions with soil, tamping the backfilled soil, smoothing the valley on both sides of the trough to form a transversely gentle slope toward the trough, and establishing sod on the sides of the valley. Thus, runoff is gently directed to the trough from the sides of the valley. There may also be an initial step of forming the valley on the hillside. Typically, the trough applying step includes assembling trough and skirt sections to form the trough and sealing the sections together in watertight fashion and the forming step includes tamping the surface between the incisions. There may also be a step of excavating a pit in the valley and installing a dry well retention basin in the pit arranged to receive runoff from a length of the trough.

The invention also includes a trough section to be assembled with other trough sections in formation of an erosionpreventing assembly. Such a trough section includes a central panel, two outwardly-extending lateral panels each of which form an angle A with the central panel greater than about 90° and less than about 170° and has a width B. Flexible skirts extend the length of the sides of the lateral panels and have a skirt width of at least $B \sin(180° - A) + 4''$. Preferably, the central and lateral panels are integrally formed, the skirts are joined to the lateral panels in watertight fashion, and the lateral panels have transverse ribs formed thereon. Additionally, one end of the trough section may be adapted to be mated in watertight fashion with another trough section.

BRIEF DESCRIPTION OF THE DRAWINGS

The invention will be better understood from a reading of the detailed description hereinafter and a study of the drawings in which.

DETAILED DESCRIPTION OF THE PREFERRED EMBODIMENT

Figure 1:
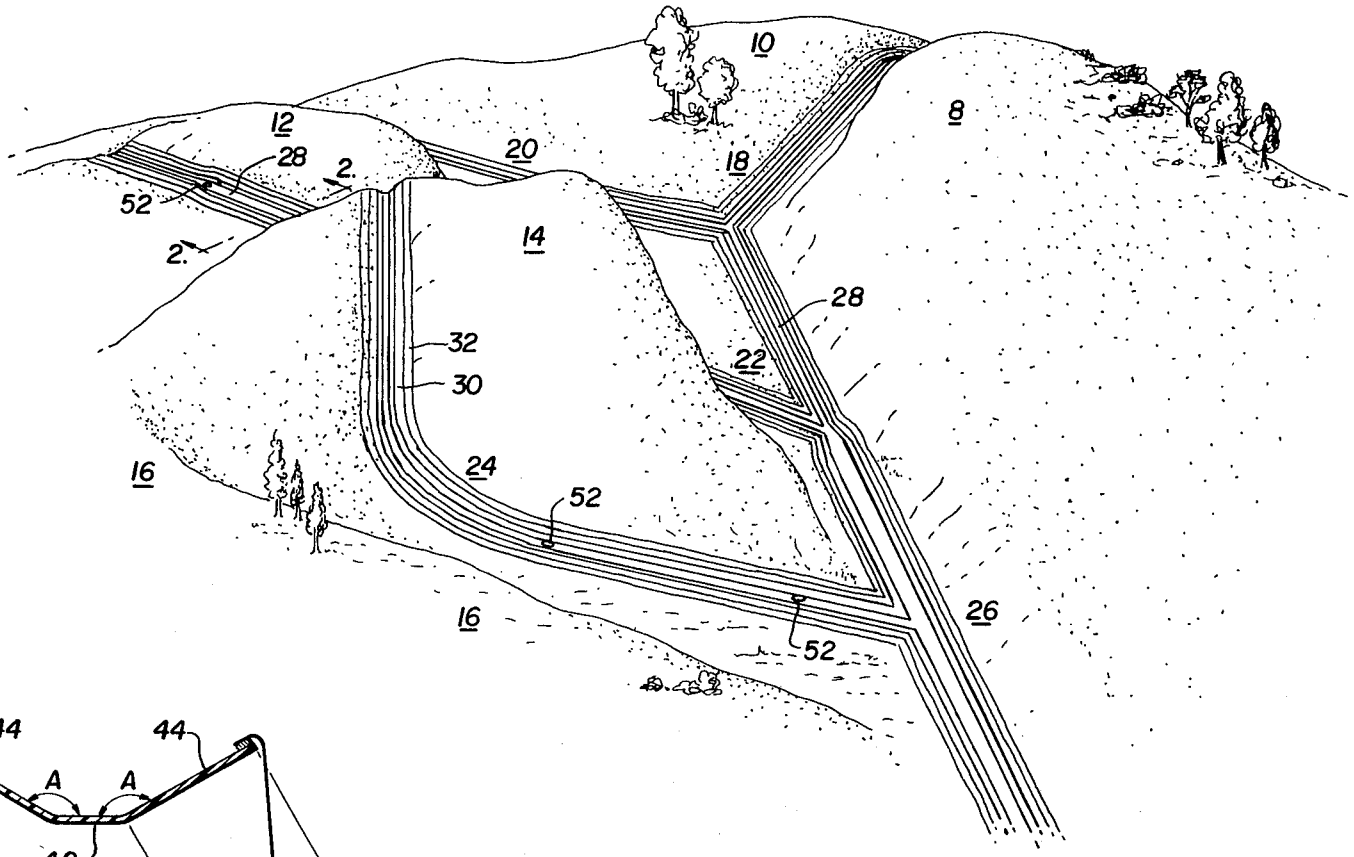
FIG. 1 is a perspective view of an installation according to the present invention.

Referring now to FIG. 1, an installation according to the invention is depicted. As can be seen, four hills 8, 10, 12, and 14 and a ridge 16 are found on a particular terrain. Of course, other terrain arrays may be protected by the invention. The landscape of FIG. 1 is purely exemplary. Between the hills are valleys 18, 20, 22, and 24, all of which eventually lead to a larger valley 26. During periods of precipitation rain falling on hill 12, as an example, will runoff into valley 20 and valley 22. From them it flows into valley 26 and then leaves the view of the FIGURE from the end of valley 26 in the lower righthand corner. As will be apparent, similar flow patterns exist with respect to the other hills and valleys.

At the bottom of each of the valleys is provided an installation according to the invention. With reference to valley 22, trough 28 at the bottom of the valley allows the water to flow toward valley 26 without contacting the soil of the bottom of valley 22. The heavy flow in the bottom of the valley is thus isolated from the soil of the valley bottom. On the two sides of trough 28 are sod strips 30 and 32. The relationship of the sod strips and the trough will be discussed in connection with FIG. 2. As can be seen in FIG. 1, the trough sections may be in varying shapes as needed to conform to the landscape. In particular, the trough may be branched and may have curved sections, as shown.

Figure 3:
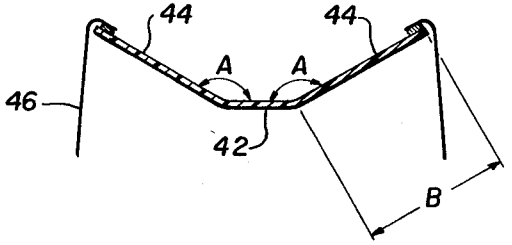
FIG. 3 is a sectional view of a trough section, taken along lines 3—3 in FIG. 2.
Figure 2:
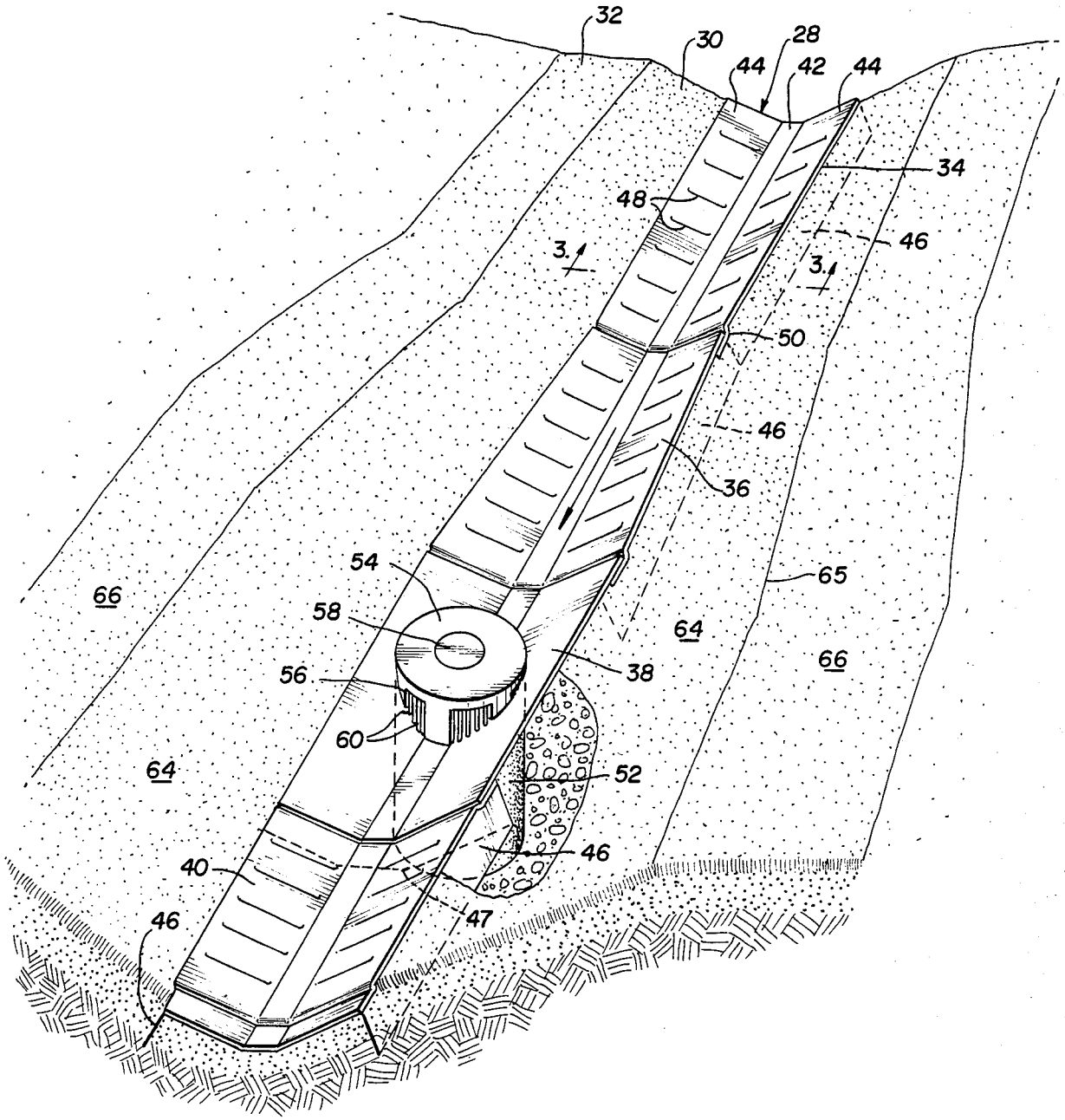
FIG. 2 is a combined sectional and perspective view with the section taken along lines 2—2 of FIG. 1.

Referring now to FIG. 2, the relationship of the trough and sod strips can be seen more clearly. Trough 28 is made up of a number of sections 34, 36, 38, and 40. Each section has a central panel 42 and two lateral panels 44. The trough sections may be of any suitable material as long as the material is impervious to water and the sections can be joined to additional sections in watertight manner. The sections may be made of any suitable material such as concrete, plastic, Fiberglas or the like, but should, of course, have the capacity to survive for many years in the climate in which they are to be installed. As can be seen in FIG. 3, the two lateral panels 44 are formed at an angle A to the central panel 42. The angles the two lateral panels make to the central panel need not be equal. It is preferred that angle A be greater than 90° and less than 170° and is preferably between about 145° and 170°. The top surfaces of lateral panels 44 are provided with transverse ribs 48.

The outwardly-extending lateral panels 44 of the troughs have a width B. Preferably, the central and lateral panels are integrally formed with one another.

The edge of each lateral panel 44 is provided with a lateral skirt 46. The skirts 46 are flexible and may be formed from a flexible plastic sheet and are sealed to their respective lateral panels in water-tight fashion, such as by mastic.

Typically the trough sections are 48 inches in length, although other lengths may be used. Adjacent trough sections are adapted to be joined together in watertight fashion. In the embodiment shown in FIG. 2 each trough section has a swaged end 50 allowing the adjacent end to be lapped onto it and sealed with a material such as a non-hardening mastic. As the trough approaches the lower end of the valley, the trough may be provided in wider sections, such as sections 38 and 40, with tapered sections, such as section 36 providing a smooth transition between narrower and wider sections. The wider sections are capable of carrying the increased quantity of water which will reach the lower end of the valley.

Section 38 is somewhat different than the other sections depicted in FIG. 2. It is provided with a drywell retention basin 52 which has its lower end extending into a pit formed in the bottom of the valley and has an upper hood section 54 with peripheral inlets 56 which are arrayed to receive water flowing down the trough and transfer it to the water table. The hood section 54 may be provided with a manhole 58 to allow basin 52 to be cleaned out periodically. In addition, the peripheral inlets 56 may be provided with bars 60 to prevent large objects from entering the drywell retention basin 52.

The section 40 downstream from the basin 52 is provided with a transverse skirt 47 which joins the two lateral skirts 46 of that section at the upper elevation of the panel. Transverse skirt 47 extends below the lowermost extent of the skirts 46, measured transversely to the skirts 47. Skirt 47 prevents water from the drywell retention basin 46 from undermining the section 40.

As mentioned above, on both sides of trough 28 are sod strips 30 and 32. These are located in areas 64 and 66, respectively. Area 66 has its sod strip 32 at grade with the adjacent hillside, but strip 30 slopes from the outer area 66 toward the edge of the trough, at a slope no greater than 1:6, measured transversely. (As will be apparent, there is another slope parallel to the length of the trough which may exceed 1:6.) The angle corresponding to the 1:6 slope is about 10°.

The installation of the apparatus will now be described. First, the bottom of the valley is identified and two longitudinal incisions are made on either side of the bottom, spaced apart by the distance between the two lateral skirts 46 of the trough. Then the bottom of the valley between the incisions is formed to receive the bottom of the trough, and is tamped to assure that the subsoil is tightly packed. The trough sections are put in place, with the lateral skirts 46 placed substantially vertically down into the incisions. The lateral skirts must extend down into the incisions to a depth below the bottom of the trough central panel 42, preferably by about 4 inches. Thus the skirt should have a width of at least $B \sin(180° - A) + 4''$.

Adjacent trough sections are installed and the joints between the adjacent sections are sealed, as are the joints between the lateral skirts of the adjacent sections. Dirt is backfilled into the incisions and tamped to assure that it is well packed. The area 64 on either side of the trough is worked to assure that it has a gentle slope to the edge of the trough, measured transversely to the longitudinal dimension of the trough. Areas 66 are conformed to the grade of the remainder of the bottom of the valley. Sod is then placed into areas 64 and 66. Since sod typically comes in elongated, 18 inch wide strips, it is convenient to install a strip in area 64 longitudinally adjacent and parallel to the trough 28. It is also convenient therefore to make the area 64 18 inches wide, although of course other widths are suitable, particularly greater widths. Similarly, the area 66 is provided with an elongated strip of sod and is typically 18 inches wide.

The installation as described prevents the water erosion of the soil of the hillside. Runoff from the hills 8, 10, 12, and 14 flows toward the areas 66 of their respective valleys. Movement through the sod slows the water flow, due to the obstruction of the established grass in the sod. The water continues slowly across area 64 by virtue of its downward slope until it reaches the trough 28. The water does not flow underneath the trough 28, because the lateral skirts 46 are sealed to the lateral panels 44 and buried below the level of the water in well tamped soil. Rather, the water is discharged onto the trough 28, and flows down the trough isolated from the soil of the bottom of the valley. Its flow in the trough is slowed by transverse ribs 48. Water which encounters a drywell retention basin 56 enters the basin from which it can then seep into the subsoil in the hill.

Thus, the hill having the installation according to the invention is not eroded by runoff, but rather the runoff is returned to the subsoil of the hill where it can be used for beneficial purposes.

The difference in elevation measured transversely between the point 65 and the edge of the trough is preferably about 3 inches, giving a 1:6 slope to the sod in area 64. The slope should be no steeper than 1:6 in order to properly retard the water flow. In some cases, it will be necessary to do some earthworking in order to shape the areas 64 and 66 at the bottom of the valley. As will be apparent, the dimensions given above are not fixed, but rather may be varied in accordance with the terrain to be protected and the prevailing climate.

In some cases, for example on a broad flat slope, there is no naturally occurring valley, and the area in which trough 28 is installed and the areas 64 on either side thereof must be excavated. As used herein, the term "valley" includes the valley resulting from such excavations.

I claim:

1. A structure for inhibiting the erosion of top soil by water flowing down a hillside and for collecting and directing a portion of said water into the subsoil of said hillside, said structure comprising, an upwardly open trough extending down the grade of said hillside, said trough having lateral skirts extending along the length of each longitudinal edge thereof, said lateral skirts buried substantially vertically in the ground to a depth below the lowermost trough depth measured transversely, said skirts and said trough being impervious to water and sealed together in watertight fashion, at least one dry well retention basin extending through a portion of said trough, said basin having its lower portion extending below said trough into a pit formed into the ground, said basin having a hood section extending upwardly from said trough and provided with peripheral inlets arrayed to receive water flowing down the trough and directing the water into the subsoil at the bottom of said basin.

2. The structure as defined in claim 1 including a skirt extending downwardly from the trough in a direction transverse to said trough, said transverse skirt extending between and joining said lateral skirts on either side of the trough, said transverse skirt being spaced from said dry well retention basin downstream from said basin whereby said transverse skirt prevents water from the dry well retention basin from undermining the soil beneath that portion of the trough downstream from said basin.

3. The structure as defined in claim 1 wherein the top of said hood section has a removable cover which permits access to the interior of said basin for periodic cleaning thereof.

4. The structure as defined in claim 3 wherein said peripheral inlets are provided with bars to prevent large objects from entering the dry well retention basin.

5. The structure as defined in claim 1 wherein said trough consists of a plurality of trough sections joined together in watertight fashion, each of said trough sections comprising a central panel having an outwardly extending lateral panel on each side thereof, each of said lateral panels forming an angle with the outer surface of said central panel greater than about 90° and less than about 170°.

6. The structure as defined in claim 5 wherein each of said lateral panels has a plurality of spaced transverse ribs on its outer surface whereby said ribs slow down the flow of water in said trough.

7. A structure as claimed in claim 1 wherein said trough has branches.

8. A structure as claimed in claim 1 wherein said valley sidewalls are no steeper transversely than about 1:6.

9. A method of preventing the erosion of top soil by water flowing down a hillside and for collecting and directing a portion of said water into the subsoil of said hillside, comprising the steps of, forming a downwardly extending valley on said hillside, said valley having a central portion and an outwardly extending lateral portion along each side of said central portion, excavating at least one pit in said central portion of said valley to a depth sufficient to collect and direct water entering said pit into the subsoil beneath said valley, installing a dry well retention basin in said pit, the lower end of said basin being open and supported by the bottom of said pit, the upper end of said basin having a hood section extending above the surface of the central portion of the valley, said hood section being provided with peripheral inlets arranged to receive water flowing down the valley and directing the water into the subsoil at the bottom of said basin, excavating an incision in said valley transverse to said valley at a distance spaced downstream from said pit, vertically excavating two longitudinal incisions on opposed sides of said valley adjacent the outer edges of said lateral portions, the depth of said incisions being lower than said central portion of said valley, installing a trough having lateral skirts extending along the length of each longitudinal edge thereof onto the surface of said valley, said surface of said valley being formed to have a configuration substantially that of the underside of said trough, installing a trough section about the hood section of said dry well retention basin, inserting said lateral skirts substantially vertically into said incisions to a depth below the depth of said central portion of said valley, inserting a skirt into said incision transverse of said valley and joining said skirt to the lateral skirts on either side of the trough, backfilling the incisions with soil and tamping the backfilled soil, smoothing the valley on both sides of the trough to form a transversely gentle slope toward said trough and establishing sod on each side of said valley to gently direct water runoff to the trough from the sides of the valley.

* * * * *